US006462262B2

(12) United States Patent
Hagiwara

(10) Patent No.: US 6,462,262 B2
(45) Date of Patent: Oct. 8, 2002

(54) DRUM

(75) Inventor: Takashi Hagiwara, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 09/849,011

(22) Filed: May 4, 2001

(65) Prior Publication Data

US 2001/0049993 A1 Dec. 13, 2001

(30) Foreign Application Priority Data

May 8, 2000 (JP) ..... 2000-134452

(51) Int. Cl.[7] ..... G10D 13/02
(52) U.S. Cl. ..... 84/411 R; 84/415; 84/416
(58) Field of Search ..... 84/411 R, 415, 84/416

(56) References Cited

U.S. PATENT DOCUMENTS 5,377,576 A * 1/1995 Good et al. ..... 84/411 R

* cited by examiner

*Primary Examiner*—Shih-Yung Hsieh
(74) *Attorney, Agent, or Firm*—Koda & Androlia

(57) ABSTRACT

A drum main body comprising first, second and third drum body elements of cylindrical shape arranged in axial direction thereof. The third drum body element is interposed between the first and second drum body elements and is connected to rims of the first and second drum body elements by fastening bolts. The first, second and third drum body elements that are arranged in an axial direction thereof can be different from each other in materials and/or structure (depth).

6 Claims, 4 Drawing Sheets

DRUM

BACKGROUND OF THE INVENTION

1. Field of the Invention

The present invention relates to a drum which is suitable for a bass drum, snare drum, marching drum, etc.

2. Prior Art

The drum main bodies of drums such as common bass drums, snare drums, marching drums, floor toms, etc. are basically formed from a single type of material. The drum main bodies provide percussive sound resonance and act as a reinforcing member that supports the drumhead and snappies (acoustic wires).

FIG. 4 illustrates a conventional snare drum shown in an inverted (upside-down) position, and FIG. 5 is a sectional view of the essential portion of this drum.

Top-side and bottom-side drumheads 2 (2*a,* 2*b*) which consist of natural leather or a resin film (e. g., a polyester resin, polycarbonate resin, etc.) are stretched over both opening ends of a cylindrical drum main body 1 by means of a plurality of head supporting and tensioning means 3. The air column (not shown) inside the drum main body 1 sealed by the drumheads is caused to act as a vibration-transmitting medium and generate a drum sound. For example, when the top-side drumhead 2*a* is struck with a stick, the internal air column transmits the resulting vibration to the bottom-side drumhead 2*b;* and when the bottom-side drumhead 2*a* thus vibrates, the internal air column transmits this vibration to the top-side drumhead 2*a*. As a result, the drumheads 2*a* and 2*b* repeatedly vibrate and produce a drum sound.

It is, therefore, required for a drum main body to stably maintain its shape, so that the drum main body undergoes no deformation caused by climactic conditions, tension on the top-side or bottom-side drumheads. It is also required for a drum main body that there be little deviation in the tone and that there be no auto-vibration or auto-absorption.

In the meantime, the tone color of drums varies according to the material used for drum main bodies. In a drum main body made of metal or a synthetic resin, the transmission velocity of the sound is high. Thus, the drum main body is superior in terms of high-tone characteristics, and the sound attenuation time is short. As a result, a light, sharp sound with a bright reverberation is produced. On the other hand, a drum main body made of wood has a slow sound transmission velocity and is therefore superior in terms of low-tone characteristics. In addition, with wooden drum bodies, the sound attenuation time is longer. As a result, with wood main drum body, a sound with greater warmth in terms of tone quality and a more settled reverberation can be obtained than a drum main body made of metal or a synthetic resin.

The above-described heat supporting and tensioning means 3 are generally constructed from annular head frames 5, annular tightening frames (rims) 6, tightening bolts 8, and other components. The annular head frames 5 are fitted over the outer circumference of the drum main body 1 and hold the circumferential rim portions of the drumheads 2. The annular tightening frames (rims) 6 are fitted over the outer circumference of the drum main body 1 and press the head frames 5. The tightening bolts 8 connect the rims 6 and lugs 7 that are fastened to the outer circumferential surface of the drum main body 1. When the rims 6 are moved in the axial direction by rotating the tightening bolts 8, the pressing force of the rims 6 on the head frames 5 varies, and as a result, the tension of the drumheads 2, i.e., the tone color of the drum, varies.

As described above, drums produce a characteristic tone color depending upon the type (size) of the drum, the materials used and other factors. However, in general conventional drums, the drum main body 1 is basically formed from a single type of material; and adjusting devices (strainers) 10, that cause the lugs 7 and snappies 9 to contact the drumhead 2*b* and separate the lugs 7 and snappies 9 from the drumhead 2*b,* are fastened to the outer circumference of the drum main body 1. Accordingly, a single drum can only be enjoyed in a single mode. In other words, it is impossible to vary the depth of a drum main body. It is also impossible to play a drum that made of a combination of different materials.

SUMMARY OF THE INVENTION

The present invention solves the above-described problems.

The object of the present invention is to provide a drum with which different modes can be played by way of using a drum body of different materials and/or structures.

The above object is accomplished by a unique structure for a drum in which drumhead(s) is stretched over the open end(s) of a drum main body by means of head supporting and tensioning means, and the unique structure of the present invention is that the drum main body is constructed from first and second drum body elements and a third drum body element which is axially interposed between the first and second drum body elements.

In this structure, the first, second and third drum body elements are formed from two or more different materials or different structures.

Furthermore, fittings such as bolts, lugs and clamps are attached to the third drum body element.

In the drum body structure of the present invention, the materials of the first, second and third drum body elements are arbitrary. A plurality of drum body elements consisting of respective different materials may be used for the first, second and third drum body elements, so that drum playing in different modes with different tone colors, etc. can be enjoyed by combining these drum body elements. One conceivable example of a drum body element with a different structure is that the drum body element to which bells are attached as in a tambourine. Fittings such as bolts, lugs and clamps can be attached to the third drum body element.

DETAILED DESCRIPTION OF THE INVENTION

Figure 1:
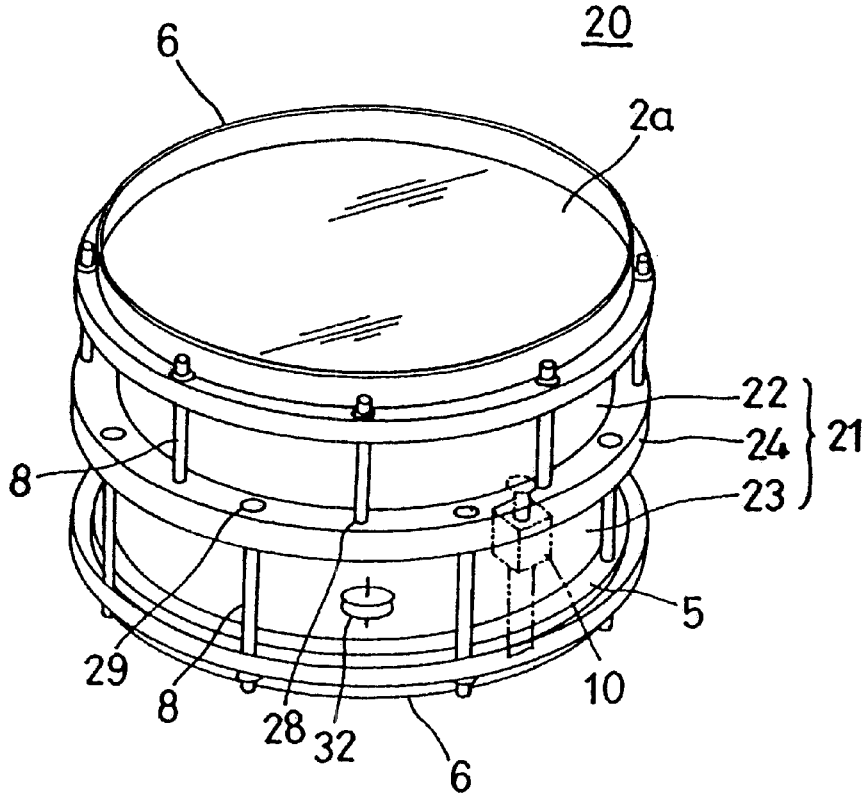
FIG. 1 is a schematic perspective view of one embodiment of the present invention applied to a snare drum.

The present invention will be described in detail below with reference to the embodiments illustrated in the accompanying drawings. In the following description, the elements that are the same as those of the prior art drum are labeled with the same reference numerals, and a description of such elements is omitted.

Figure 2:
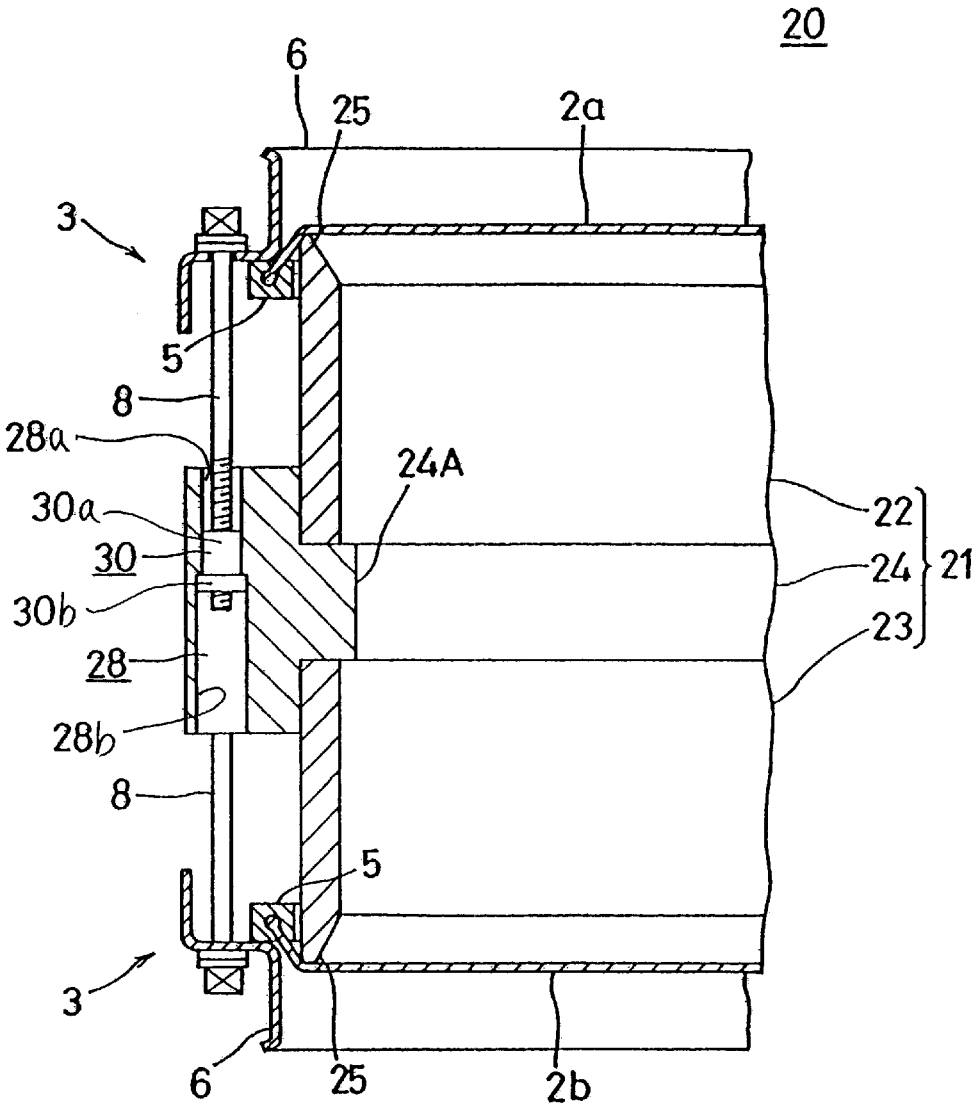
FIG. 2 is a sectional view of the essential portion thereof.
Figure 3:
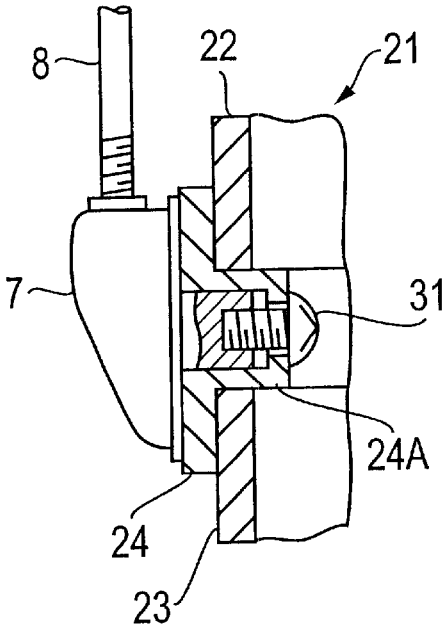
FIG. 3 is a sectional view of the essential portion of another embodiment of the present invention.

In FIGS. 1 through 3, the snare drum 20 is comprised of a cylindrical drum main body 21 and top-side and bottom-side drumheads 2*a* and 2*b*. The drumheads 2*a* and 2*b* are respectively stretched over the openings at both ends of the drum main body 21 by means of head supporting and tensioning means 3 comprising head frames 5, rims 6, tightening bolts 8 and other components (not shown).

The drum main body 21 comprises three sections arranged in the axial direction. In other words, the drum main body 21 is comprised of first and second drum body elements 22 and 23 and a third drum body element 24 which is interposed between the first and second drum body elements 22 and 23. The first and second drum body elements 22 and 23 have the same cylindrical shape, and the top-side and bottom-side drumheads 2*a* and 2*b* are stretched over the open ends 25 and 26 located on the opposite sides of the respective drum body elements 22 and 23 from the third drum body element 24. The inside circumferential edges of the open ends 25 and 26 of the first and second drum body elements 22 and 23 are cut into a cross-sectional V shape, thus forming head supporting edges for the drumheads 2*a* and 2*b*.

The third drum body element 24 has also a cylindrical shape. The third drum body element 24 is shallower in depth than the first and second drum body elements 22 and 23, and its internal diameter is slightly greater than the external diameters of the first and second drum body constituent parts 22 and 23. An internal annular ridge 24A is formed as an integral part of the center area of the inside surface of this third drum body element 24 and protrudes inwardly.

A plurality of bolt attachment holes 28 and 29 are formed in the third drum body element 24 at equal intervals in the circumferential direction so as to pass through the upper and lower surfaces thereof. Tightening bolts 8 that connect the rims 6 of the top-side and bottom-side drumheads 2*a* and 2*b* to the third drum body element 24 are respectively passed through the bolt attachment holes 28 and 29.

The bolt attachment holes 28 that are used for the top-side drumhead 2*a* and the bolt attachment holes 29 that are used for the bottom-side drumhead 2*b* are provided so as to be shifted by one-half pitch relative to each other.

Each of the bolt attachment holes 28 and 29 has different inner diameters, thus forming a smaller diameter section 28*a* (29*a*) and a larger diameter section 28*b* (29*b*). Nuts 30 to which the tightening bolts 8 are screwed are installed inside the bolt attachment holes 28 and 29. The head portion 30*b* of each nut 30 is in the larger diameter section 28*b* (29*b*), and the leg portion 30*a* of each nut 30 and each bolt 8 are inside the smaller diameter section 28*a* (29*a*).

Accordingly, in the shown embodiment, the third drum body element 24 functions as a lug. However, as seen from FIG. 3, it is possible to form the third drum body element 24 as a thin cylindrical body. With this thin cylindrical third drum body element 24, lugs 7 are fastened to the third drum body element 24 by set screws 31, and the tightening bolts 8 are connected to the lugs 7. It would be possible to attach clamps that are used for attaching a plurality of tom-toms to a stand or used for attaching a plurality of legs of a floor tom.

Figure 4:
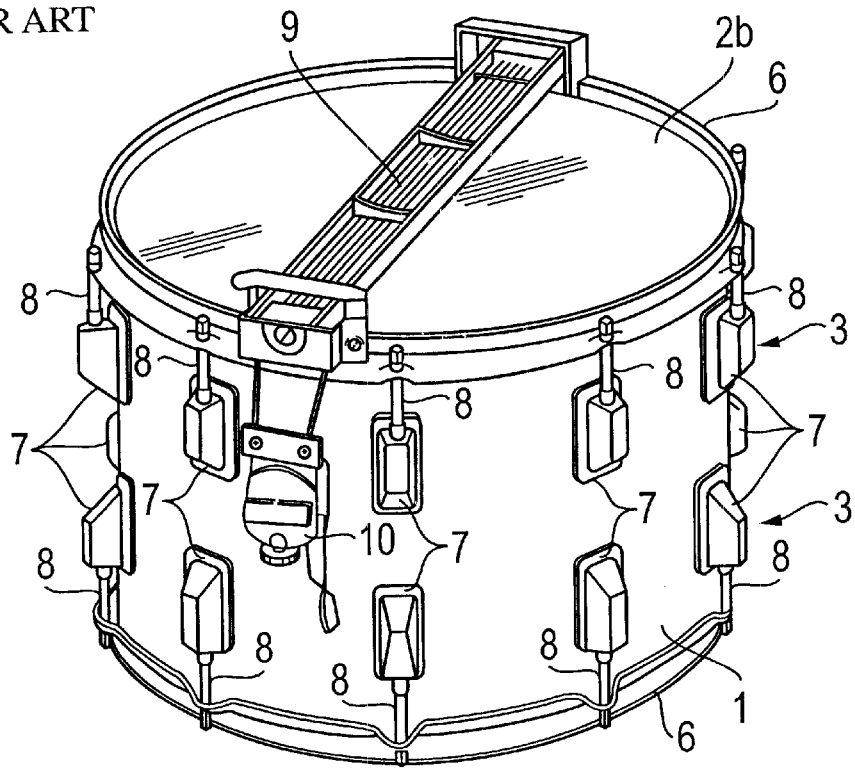
FIG. 4 PRIOR ART
FIG. 4 is an external perspective view of a conventional snare drum.
Figure 5:
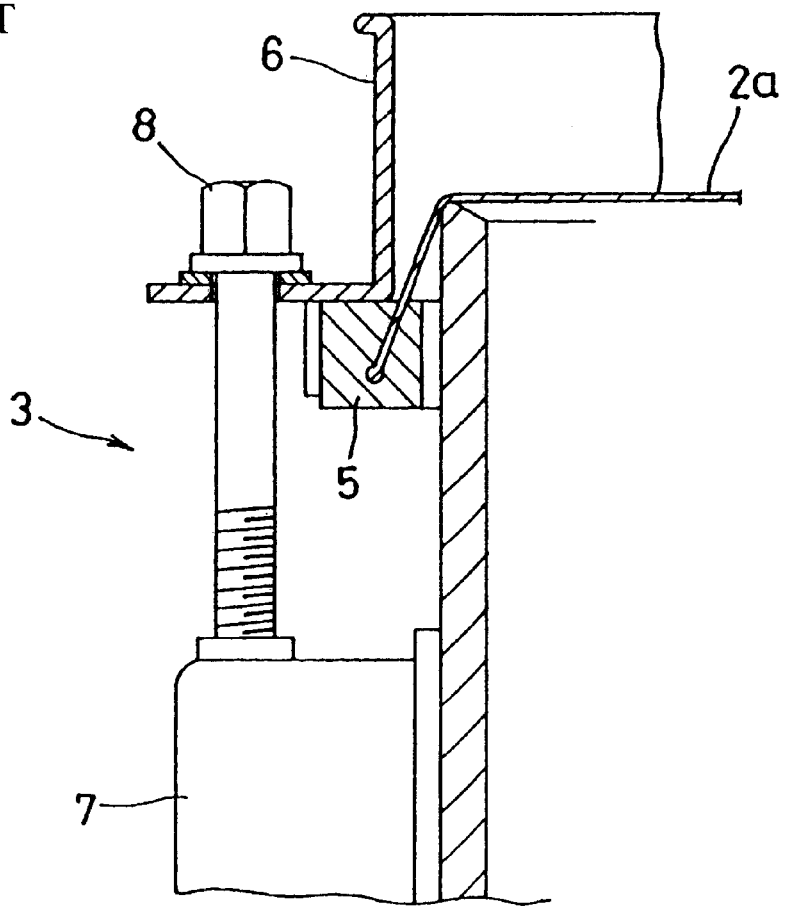
FIG. 5 PRIOR ART
FIG. 5 is a sectional view of the essential portion thereof.

As indicated by the two-dot chain lines in FIG. 1, an adjusting device 10 for operating the snappies (see FIG. 4) is attached on the outer circumference of the third drum body element 24. Fittings such as the tightening bolts, lugs, clamps, etc. can also be attached on the third drum body element 24.

For the first, second and third drum body elements 22, 23 and 24, any desired material can be used as the material. A plurality of different types of drum body elements respectively formed from wood such as maples, mahoganies, etc., metals such as aluminum, steels, etc., or FRP (fiber-reinforced plastics), etc. can be employed.

Furthermore, different types of drum body elements that are made of the same material but have different depths can be employed. By preparing a plurality of different types of drum body elements that are made of different materials or have different depths, various combinations are available. The first, second and third drum body elements 22, 23 and 24 can be all the same, for instance wood. Instead, the three drum body elements all made of different materials can be used in accordance with the type of play desired.

For example, metal drum body elements may be used as the first and second drum body elements 22 and 23, while a wooden drum body element is used as the third drum body element 24. Alternatively, wooden drum body elements may be used as the first and second drum body elements 22 and 23, while a synthetic resin drum body element is used as the third drum body element 24; or a wooden drum body element may be used as the first drum body element 22, while a metal drum body element is used as the second drum body element 23 and a synthetic resin drum body element is used as the third drum body element 24. By thus selecting the drum body elements of different materials, depending upon the type of music for instance, the tone color, high- and low-tone characteristics, attenuation time, etc. can be varied according to the preferred combination of materials used.

Furthermore, with the same material for all three drum body elements, the tone color, etc. can be varied by using combinations of drum body elements with different depths. For instance, by setting the depth of the first drum body element 22 at 50.8 mm, and setting the depth of the second drum body element 23 at 25.4 mm, the tone color and other sound characteristics can be changed.

In regard to the third drum body element 24, there is no absolute need to prepare drum body elements of different depth, and the third drum body element 24 may have the same depth as the first and second elements. Moreover, as a special drum body, it would be possible to attach bells 32 to the outer circumference of the first or second drum body element 22 or 23 as seen in a tambourine.

In use, the first and second drum body elements 22 and 23 are first engaged with the inner circumference of the third drum body element 24 from above and below. Then, the top-side and bottom-side drumheads 2*a* and 2*b* are stretched over the open ends of the first and second drum body elements 23 and 24 by the head supporting and tensioning means 3. Further, the rims 6 and third drum body element 24 are connected by the tightening bolts 8. When the tightening bolts 8 are tightened, the first and second drum body elements 22 and 23 are respectively pressed against the upper and lower surfaces of the internal annular ridge 24A of the third drum body element 24. As a result, the single drum body 21 is obtained. Thus, the assembly of the drum main body 21 is simple and easy, with no need for fastening with set screws, etc.

The above embodiment is described with reference to a snare drum. However, the present invention is not limited to this and is applicable to other types of drums such as marching drums, floor toms, tom-toms, etc. If a drumhead is stretched only over the first drum body element 22, the resulting drum can be used as a single drum.

Furthermore, in the above-described embodiment, the first and second drum body elements 22 and 23 have the same external diameter and same internal diameter. One of these drum body elements, however, may have a larger diameter and the other a smaller diameter. In this structure, the third drum body element 24 has different internal diameters for matching the first and second drum body elements 22 and 23 of different diameters.

The shown embodiment refers to the drum body 21 that is comprised of the first, second and third drum body elements. The present invention is further applicable for a drum body that is comprised of four or more drum body elements.

As seen from the above, according to the present invention, a drum main body is constructed from three drum body elements. Accordingly, by way of appropriately combining drum body elements with different materials and/or structures in accordance with the desired mode of playing, it is possible to vary the vibration attenuation time, sound quantity, tone color, etc., and drum playing in modes that are different from the conventional modes can be enjoyed.

Furthermore, in the present invention, the structure of the drum main body is simple and can easily be manufactured and assembled.

What is claimed is:

1. A drum in which drumheads are stretched over open ends of a drum main body by means of head supporting and tensioning means, wherein said drum main body is comprised of first and second drum body elements and a third drum body element which is interposed between said first and second drum body elements, and said first and second drum body elements are fitted inside said third drum body element.

2. The drum according to claim 1, wherein said first, second and third drum body elements are made of different materials.

3. The drum according to claim 1, wherein said first, second and third drum body elements differ from each other in depth thereof.

4. The drum according to claim 1, wherein a fitting of at least one type selected from the group consisting of bolts, lugs and clamps is attached to said third drum body element.

5. The drum according to claim 2, wherein a fitting of at least one type selected from the group consisting of bolts, lugs and clamps is attached to said third drum body element.

6. The drum according to claim 3, wherein a fitting of at least one type selected from the group consisting of bolts, lugs and clamps is attached to said third drum body element.

* * * * *